United States Patent [19]

Sagan et al.

[11] 4,246,958

[45] Jan. 27, 1981

[54] TUBE TO TUBESHEET CONNECTION SYSTEM

[75] Inventors: Stanley S. Sagan, Springfield; Angelo R. Giardina, Marple Township, Delaware County, both of Pa.; Samuel D. Reynolds, Jr., St. Petersburg, Fla.

[73] Assignee: Westinghouse Electric Corp., Pittsburgh, Pa.

[21] Appl. No.: 888,724

[22] Filed: Mar. 21, 1978

[51] Int. Cl.[3] ..... F28F 11/00; B23P 15/26

[52] U.S. Cl. ..... 165/70; 29/157.3 C; 165/11 R; 165/173; 285/13

[58] Field of Search ..... 165/70, 11, 173; 29/157.3 C, 157.4; 285/14, 13

[56] References Cited

U.S. PATENT DOCUMENTS

| | | | |
|---|---|---|---|
| 1,945,103 | 1/1934 | Vis | 165/11 |
| 1,987,891 | 1/1935 | Cattanach | 165/11 |
| 2,743,089 | 4/1956 | Gardner et al. | 165/11 |
| 2,768,813 | 10/1956 | Boyer | 165/70 |
| 2,915,295 | 12/1959 | Boni, Jr. | 165/11 |
| 3,945,431 | 3/1976 | Straub | 165/11 |

FOREIGN PATENT DOCUMENTS

| | | | |
|---|---|---|---|
| 684736 | 12/1939 | Fed. Rep. of Germany | 165/11 |

*Primary Examiner*—Francis S. Husar
*Assistant Examiner*—V. K. Rising
*Attorney, Agent, or Firm*—G. H. Telfer

[57] ABSTRACT

A tube to composite tubesheet connection system for preventing fluid leakage from the shell to the tube side and from the tube side to the shell side of a shell and tube heat exchanger. Tubes are inserted through and fastened to an inner tubesheet structure. An outer tubesheet structure constituting a plurality of outer tubesheet covers cooperates with the tubes which protrude therethrough and with the inner tubesheet to form a plurality of cavities. The inter-tubesheet cavities about each row or column of tubes are interconnected in a variety of ways. Grooving at least one of the tubesheet structures about its tube holes provides groove-cavities which may be selectively interconnected by networks of holes formed in at least one of the tubesheet structures. Additional cavity interconnection systems include outer tubesheet covers grouped together in sets of cover strips which enclose furrows formed between selected cavities in the outer surface of the inner tubesheet and metallurgically partially refilled portions of a plurality of channels formed between selected cavities in the outer surface of the inner tubesheet. Cavities may also be provided by assembling concave or channel-shaped outer tubesheet covers with the tubes and the inner tubesheet structure. Such cavities must be interconnected by a plurality of hole networks primarily concealed within the inner tubesheet but which connect selected cavities. A final technique for selectively connecting the inter-tubesheet cavities is grooving at least one of the tubesheet structures about the tube holes so as to cause the grooves to intersect and thus connect, or more correctly, form the cavities. The aforementioned grooving connection, however, requires nonstandard tube pitches to limit the interconnections to predetermined, localized areas which facilitate isolation of tube leaks to such predetermined areas as single rows or columns of tubes.

4 Claims, 22 Drawing Figures

FIG.1
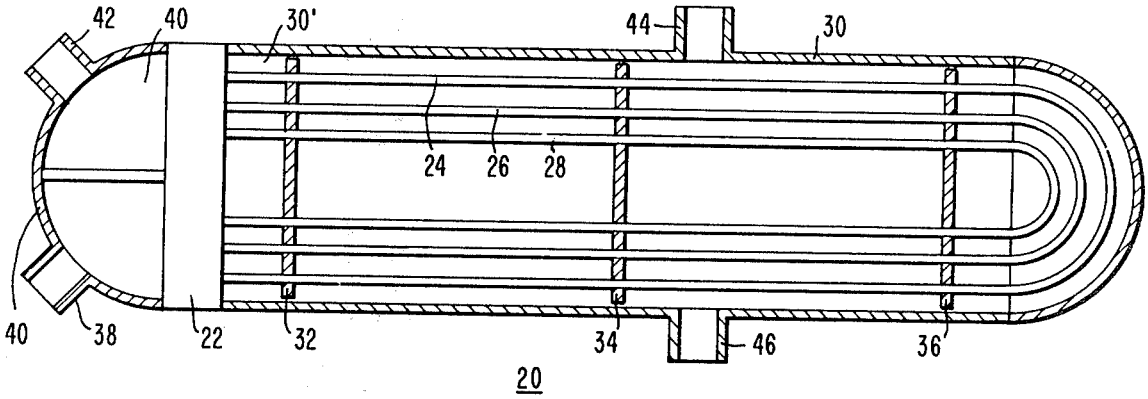
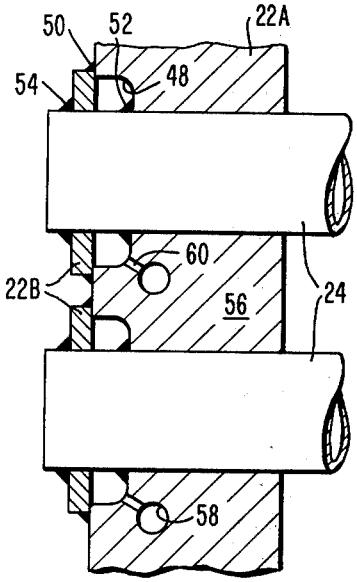
FIG.2
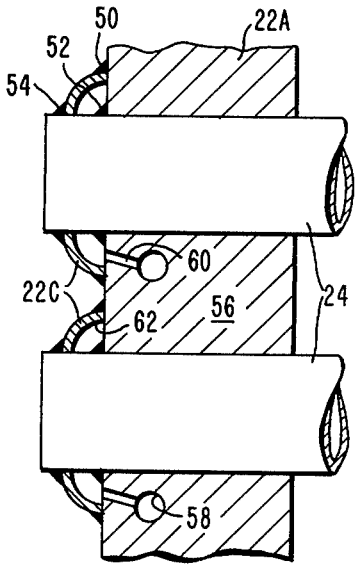
FIG.3

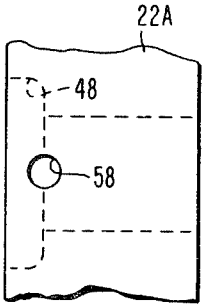
FIG.4A
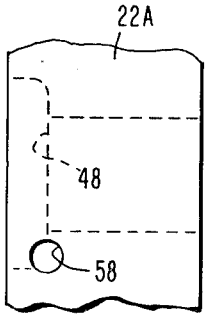
FIG.4B
FIG.11
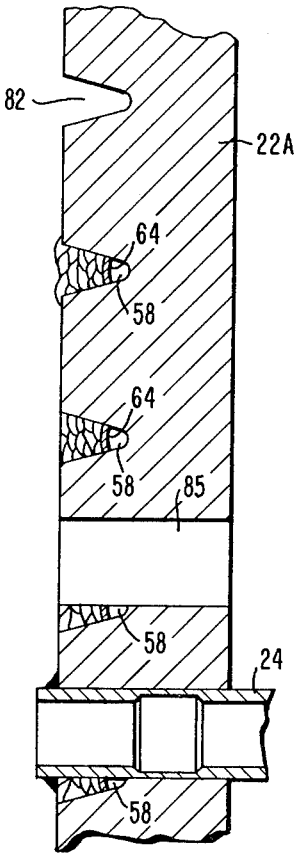
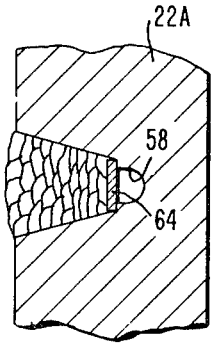
FIG.5A
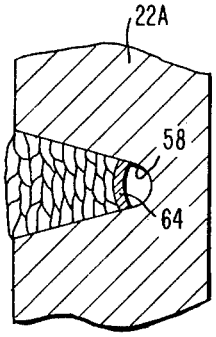
FIG.5B
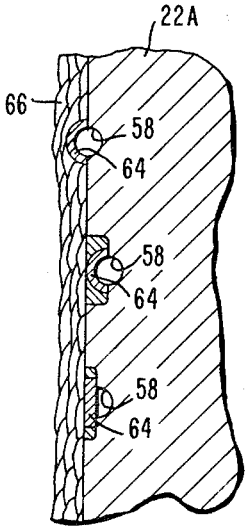
FIG.6A
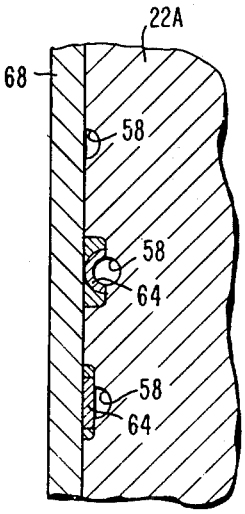
FIG.6B

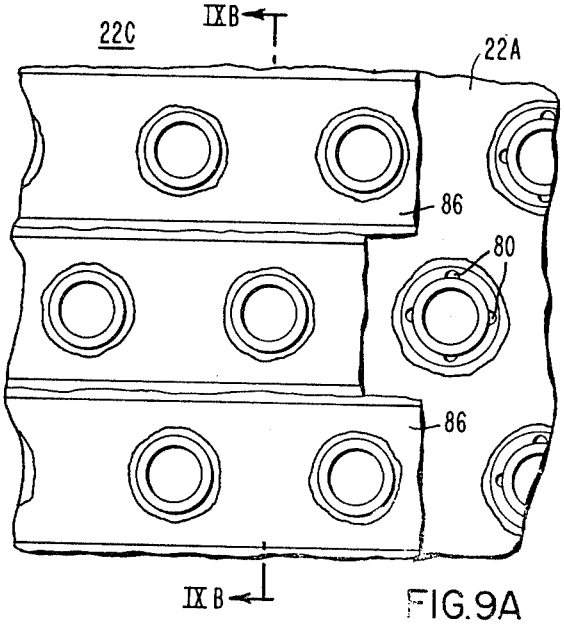
FIG.9A
FIG.9B
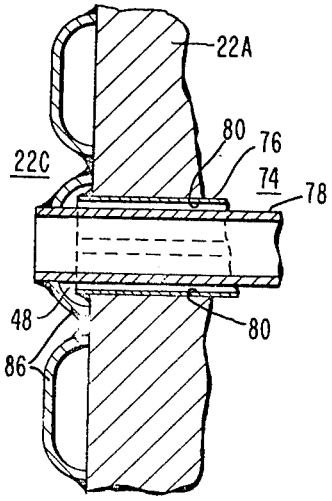
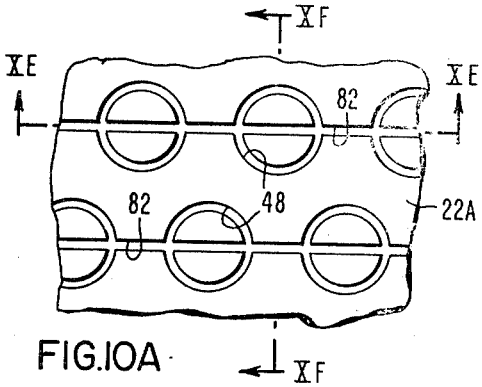
FIG.10A
FIG.10B
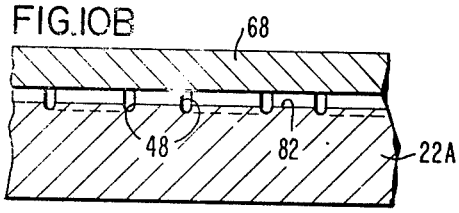
FIG.10C
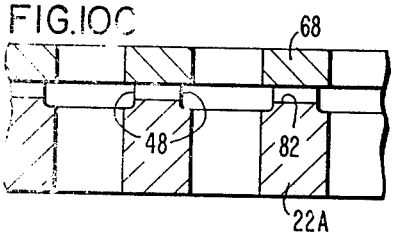
FIG.10D
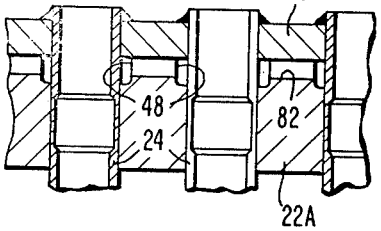
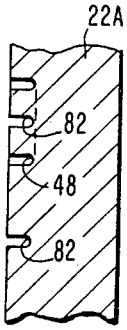
FIG.10F
FIG.10E
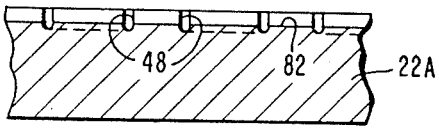

TUBE TO TUBESHEET CONNECTION SYSTEM

BACKGROUND OF THE INVENTION

1. Field of the Invention

This invention relates to shell and tube heat exchangers, and more particularly, to means for producing and joining composite tubesheets to intersecting tubes.

2. Description of the Prior Art

Shell and tube heat exchangers are widely used in industry and, in practice, handle a variety of fluids on the shell and tube sides. Single tubesheets have often been joined to intersecting tubes by welding or rolling the tubes to the tubesheet. Operating experience has shown some of those joints to be susceptible to leaks which permit intrusion of the higher pressure fluid (shell or tube side) into the lower pressure fluid (shell or tube side). Depending upon the heat exchanger application, the nature of the shell and tube side fluids, and the extent of the leak, it may be necessary to suspend operation of the heat exchanger and repair the leak or leaks. In the particular case of a heat exchanger in a power plant cycle, shutdown of such heat exchanger and interruption of the associated power cycle can add further strain to the already serious energy shortage in addition to resulting in losses of $100,000 per day and more at typical cost figures. Leak monitoring for heat exchangers with single tubesheets is difficult at best and often provides leak detection for only substantially sized leaks.

Double tubesheets were developed to provide greater reliability and better leak detection than is available for single tubesheet structures. Double tubesheets usually constitute two tubesheets which have tubes protruding through both and a gap arranged therebetween. The tubes are secured in sealing contact with each of the tubesheets and thus cause the intervening gap to be fluidtight. Two types of double tubesheet structures exist: (1) an integral double tubesheet fabricated from a single plate with interconnecting annular grooves formed interiorly about the tube holes which extend entirely through both tubesheets and (2) two substantially planar tubesheets which are fabricated so as to be joined together at their outer peripheries and have a fluidtight gap therebetween with the tubes extending across the gap and protruding through both tubesheets. The former prior art double tubesheet structure is characterized by German Pat. No. 624,385 which issued in 1935 and the second structure is characteristic of many heat exchangers now in service. The aforementioned double tubesheet structures provided greater reliability than single tubesheet structures due to the multiple joint formations between each tube and the tubesheets. Such double tubesheets also provided better leak detection than the single tubesheet structures by virtue of the fact that detection devices could monitor the presence of any fluid within the gap, a change in the pressure of buffer fluid placed in the gap, or any other parameter which reflected the condition of the intervening gap or resident fluid therein. Leak detection in single tubesheet structures is often difficults since the leaking fluid tends to beome diluted in the intrudedupon fluid due to the leaking fluid's usually comparatively small leaking flow rate.

While prior art double tubesheet systems provide relatively greater reliability and superior leak detection over single tubesheet systems, those prior art double tubesheet systems suffer from inaccessibility to the inner tube joints when maintenance is necessary and provide little, if any, leak detection localization. The joints between the tubes and the inner tubesheet of integral double tubesheets cannot be welded and thus must be rolled or otherwise mechanically connected. Such mechanically connected joints are more susceptible to leaks than welded joints and thus substantially reduce the normally greater reliability of double tubesheet systems. Furthermore, accessibility to the inner joint for the parallel, separate tubesheet system requires removal of the entire outer tubesheet structure and destruction of all the tubes' joints therewith. Since both prior art double tubesheet structures contain single large cavities between the tubesheets and about all the tubes, finding leaks during inspection can be difficult in heat exchangers having an appreciable number of tubes.

The problems associated with prior double tube-sheet systems stem directly from their relatively inaccessible inner tube-to-tubesheet joints and the accompanying difficulty in welding those joints. Additional disadvantages of the prior art include poor localization of the tube joints which require leak testing after a leak has been detected and low tube joint flexibility.

SUMMARY OF THE INVENTION

In accordance with the present invention, an improved heat exchanger apparatus and method for forming its tube-to-tubesheet connection system are provided for securing tubes from a shell and tube heat exchanger in a composite tubesheet structure. Cavities formed about the tubes between the composite tubesheets' inner and outer joints are selectively interconnected for improved leak detection and localization of leaks while permitting high accessibility to the inner joint for subsequent repair. Detection of leaks within channels that interconnect selected cavities reduce the number of tube-to-tubesheet joints which are candidates for earlier detected leaks and thus increase the precision of locating and decrease the time to find leaking joints during inspection and maintenance. The invention generally comprises a shell structure with tubes disposed therein, a tubesheet apparatus which cooperates with the shell to isolate the shell's interior from the tube's interior with that tubesheet apparatus including an inner and an outer tubesheet structure each of which have a plurality of holes therein for receiving said tubes, and means for fluidly interconnecting selected cavities which are formed between the tubesheet structures about the tubes. The cavities result from grooving at least one of the tubesheet structures about the tubes, utilizing outer tubesheet covers whose inner surface is generally concave, or both, or partially refilling furrows formed between tube holes on at least one of the tubesheet structures. Selected cavities are interconnected by channels disposed therebetween with such channels including a plurality of furrows formed at the interfacing, cooperating surfaces of said outer tubesheet covers and said inner tubesheet and a plurality of concealed openings in at least one of said tubesheet structures which result from drilling holes therein or forming furrows whose outer portions are metallurgically refilled so as to leave voids along those furrows' inner portions.

Single wall and duplex or double wall tubes having inner and outer walls can be used with the present invention's composite tubesheet structure. Single wall tubes are joined to the inner and outer tubesheet structures and the inner and outer tubesheet structures are likewise joined. The inner wall of a duplex tube is joined to the outer tubesheet structure, the outer wall of the duplex tube is joined to the inner tubesheet structure, and the inner and outer tubesheet structures are joined such that the cavities surrounding the tubes are fluidly connected with gaps separating the inner and outer walls of the duplex tubes. The composite tubesheet structure of the present invention provides improved access to the inner tube to tubesheet joint, permits the use of a welded inner joint for increased reliability, provides localization of tube joint candidates for leak testing after leak detection, and increases tube-tubesheet joint flexibility.

BRIEF DESCRIPTION OF THE DRAWINGS

The invention will be more fully understood from the following detail description of a preferred embodiment, taken in connection with the accompanying drawings, in which:

FIG. 1 is a partial transverse sectional view of an exemplary heat exchanger;

FIGS. 2 and 3 are sectional views of composite tubesheet structure with tubes situated therein;

FIGS. 4A, 4B, 5A, 5B, 6A, 6B, 7A, and 7B are sectional views of inner tubesheet structures utilizing various ways to form interconnected openings between grooves which are formed about selected tubes;

FIGS. 8 and 9 illustrate outer tubeplate cover strips which are respectively flat and channel-shaped;

FIG. 10 illustrates the progressive steps used to form the inner tubesheet structure with grooves about its tube holes and the interconnecting furrows; and FIG. 11 illustrates an alternate set of progressive steps for interconnecting cavities about tubes to one another.

DESCRIPTION OF THE PREFERRED EMBODIMENT

Figure 7A:
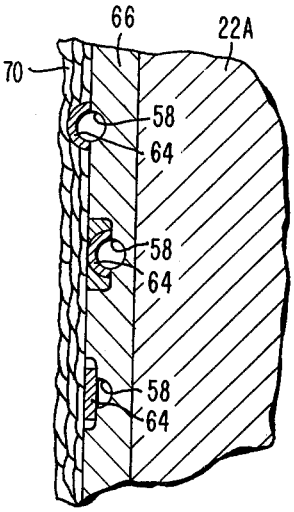

The present invention is concerned primarily with joining tubes to composite tubesheets which constitute parts of shell and tube heat exchangers. Accordingly, in the description which follows the invention is shown embodied in a shell and tube heat exchanger. It should be understood, however, that the invention may be utilized for any application which requires tubes to be joined in a fluidtight and optimally flexible manner to a tubesheet or tubesheets.

FIG. 1 illustrates a partial sectional view of a shell and tube heat exchanger 20 which has a tubesheet 22 (not sectioned), a plurality of U-tubes 24, 26, 28, a shell structure 30, and a plurality of tube supports 32, 34, and 36. Although U-tubes are illustrated in FIG. 1, it is to be understood that straight tubes could be utilized equally well in the present invention. Tubes 24–28 are joined in fluidtight relationship with tubesheet structure 22 so as to prevent fluid leakage from the tube side to the shell side and vice versa. Tube side fluid normally enters inlet nozzle 38 and flows through the inlet portion of chamber 40, through the U-tubes 24–28, departing heat exchanger 20 through the outlet portion of chamber 40, and exiting chamber 40 through outlet nozzle 42. The inlet and outlet portions of chamber 40 are normally separated by a partition plate or other fluidtight sealing member (not shown). Shell side fluid normally enters nozzle 44, passes over the exterior of tubes 24, 26 and 28, and exits the shell size through nozzle 46. The shell side fluid and tube side fluid exchange heat therebetween through the walls of the tubes. Typical examples of such heat exchangers commonly used in power plant cycles are condensers, feedwater heaters and nuclear steam generators.

FIG. 2 is a sectional view of one embodiment of the present invention. A portion of tubesheet structure 22 is illustrated in FIG. 2 and includes inner tubesheet **22*a* which is adjacent shell side 30' and outer tubesheet structure 22*b* adjacent tube side 40'. Grooves 48 are formed about each tube 24 and thus provide cavities which are bounded by inner tubesheet 22*a*, outer tubesheet covers 22*b*, and tube 24. Tubesheet 22*a* and 22*b* are sealed together by fluidtight joints 50 which commonly constitute fillet welds. Tube 24 is sealed to both tubesheet 22*a* and tubesheet 22*b* by fillet welds 52 and 54 respectively. For purposes of the present invention, however, it is to be understood that joints 52 and 54 may be welded with other weld geometries, rolled or formed in a manner other than welding. Cavities 48 situated about each tube between the tubesheet structures are fluidly connected to other selected cavities 48 (in this case the tube row into and out of the paper) by networks of connecting holes 56 which in this case include transverse headers 58 and secondary conduits 60. Hole networks 56 and connected cavities 48 may be monitored for leaks through the inner and outer joints 50–54 associated therewith. Normally, the cavities are maintained under vacuum or pressure and predetermined changes in that vacuum or pressure may be interpreted as leaks from the shell or tube side for the group of tubes whose cavities 48 are interconnected. Thus, the leaking tube-to-tubesheet or tubesheet-to-tubesheet joint can be localized to the particular set of tubes whose cavities 48 are fluidly connected to the hole network 56 where the leak is detected. Additional leak detection systems include monitoring the content of a third fluid which normally fills cavities 48 and is in the pure state. Any leak detection system, however, which separately monitors each of the hole networks 56** greatly simplifies any necessary leak repair and permits an orderly shutdown of the utilizing apparatus in preparation therefor.

FIG. 3 illustrates an alternate embodiment whose outer tubeplate covers **22*c* are concave or channel-shaped. The purpose for such shape is two-fold; greater joint flexibility for reduced tube joint stresses during transient operation is provided and counterboring about each tube is obviated due to covers 22*c* having inherent cavities 62 on their side adjacent inner tubesheet 22*a***.

FIGS. 4A to 4B illustrate alternate embodiments for transverse headers 58 which permit elimination of secondary conduits 60. Transverse headers 58 are seen to intersect with grooves formed about the tube holes as was illustrated in FIG. 2. Such transverse header formation is preferably accomplished prior to grooving and tube hole drilling. FIGS. 5A and 5B illustrate alternate embodiments of headers 58. FIGS. 5A and 5B require furrowing the outer surface of inner tubesheet **22*a*, insertion of welding backup strips 64, and subsequent filling of the furrows above the weld strips with weld metal. By suitably forming weld strips 64 the desired cross-section of headers 58** may be obtained.

Figure 7B:
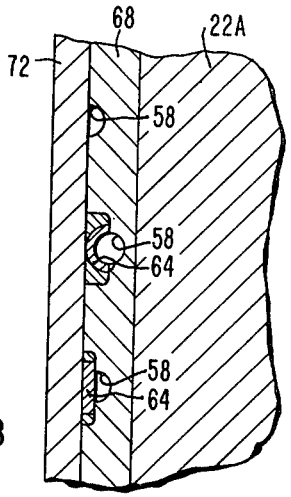

FIGS. 6A and 6B illustrate formation of headers 58 for inner tubesheets **22*a* when they are clad by welding and explosive or brazing techniques respectively. Weld cladding 66 deposited above weld strips 64 which were inserted in furrows previously formed in inner tubesheet 22*a* result in the formation of headers 58. FIG. 6B** illustrates three alternate embodiments of headers 58 utilized when tubesheet 22*a* is clad by explosive techniques, roll bonding, or brazing. It can be seen in FIG. 6B that weld strips 64 are not necessary when tubesheet 22*a* is clad with one of the above-used techniques under appropriate conditions. FIGS. 7A and 7B illustrate formation of headers 58 when tubesheets 22*a* are multiply clad by welding and explosive bonding respectively. Such double cladding may be useful in a variety of circumstances including when it is desired to provide corrosion resistant material about the headers 58 which are to be monitored for joint leaks. Headers 58 are most conveniently located at the interface or near the interface between outer weld cladding 70 and inner cladding 66 and also between outer explosively clad layer 72 and inner cladding 68.

Figure 8A:
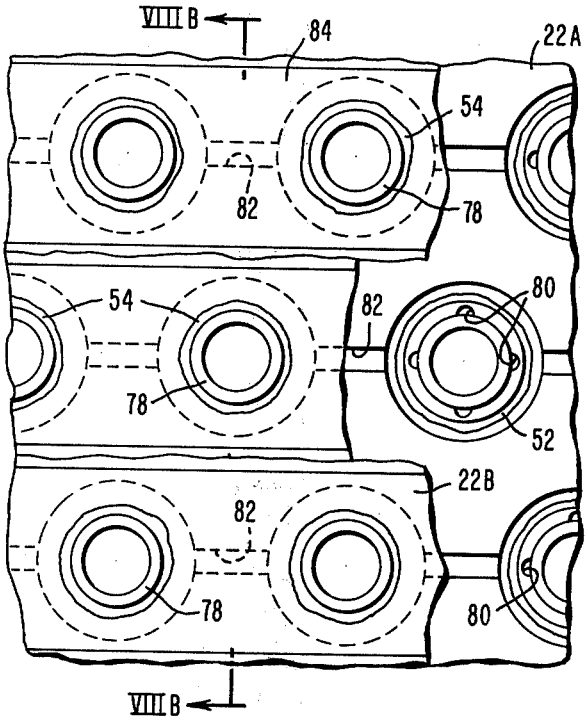
Figure 8B:
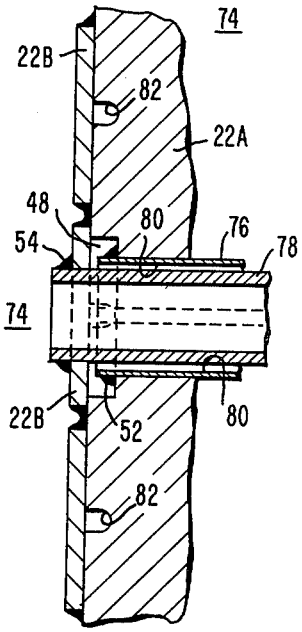

FIGS. 8A and 8B respectively illustrate a plan view and sectional view of duplex tubes 74 which are connected to inner and outer tubesheet structures 22*a* and 22*b*. Duplex tubes 74 constitute an outer wall 76 and an inner wall 78 separated by longitudinal space 80 which is in fluid communication with the grooved cavities 48. Furrows or indentations 82 formed in the outward facing surface of inner tubesheet 22*a* provide fluid communication between selected cavities 48. Furrows 82, when covered with a series of outer tubesheet covers 22*b* which are grouped into strip sets 84, are fluidly sealed by welds 50 disposed about the edges of strip sets 84. Grouping of such covers 22*b* into strip sets 84 can reduce the total amount of welding required from that of the double tubesheet configuration illustrated in FIG. 2.

FIGS. 9A and 9B are plan views and sectional views of duplex tubes 74 connected with inner tubesheet 22*a* and outer tubesheet structure 22*c*. The channel-shaped, outer tubesheet structure 22*c* is analogous to that illustrated in FIG. 3 with two notable exceptions: (1) FIGS. 9A and 9B illustrate an embodiment of outer tubesheet structure 22*c* comprising channel-shaped cover strips 86 and (2) FIGS. 9A and 9B do not require headers 58 and secondary conduits 60 since fluid communication between cavities 48 about each tube are inherently present due to the shape of the longitudinally channel-shaped outer tubesheet cover strips 86. Although FIGS. 8A, 8B, 9A, and 9B illustrate a duplex tube structure 74, it is to be understood that a single wall tube could likewise be used with the present invention and still obtain all the advantages thereof. It is to be further noted that for an array of tubes arranged in a triangular pattern, the longitudinal shapes of the cover strips may have wavy rather than straight contours when seen from the plan view of the tubesheet structure. Such wavy contours are often useful in accommodating relatively small tube pitches.

FIGS. 10A–10D sequentially illustrate typical steps in forming inner tubesheet 22*a* and fastening a mating tube thereto. FIG. 10A shows groove 48 formation about the position of future tube holes and the cutting of furrows 82 which intersect such grooves. FIG. 10B illustrates a cross-section of inner tubesheet 22*a* subsequent to deposition of cladding layer 68. FIG. 10C shows cladded tubesheet 22*a* with tube holes drilled therethrough and FIG. 10D shows exemplary tubes 24 which have been expanded into inner tubesheet 22*a* and welded to outer tubesheet cladding layer 68. FIGS. 10E and 10F are sectional views taken along the appropriate section lines indicated in FIG. 10A. It is to be understood that furrows 82 are obviated when successive circular grooves 48 intersect in rows or columns.

FIG. 11 illustrates schematically the preferred sequence of operations (from right to left) for forming an additional composite tubesheet configuration by cutting furrows 82 in tubesheet 22*a* and refilling a portion of those furrows. Furrows 82 are initially formed and are subsequently partialled refilled with weld metal. To facilitate weld metal refilling while simultaneously assuring the presence of headers 58 thereunder, welding strips 64 are placed near the bottom of the groove and weld metal is deposited thereover. Such weld metal is then, preferably, ground flush with that face of tubesheet 22*a*. Tube holes 85 are then drilled to intersect with headers 58. Tubes 24 inserted in holes 84 are then secured to tubesheet 22*a* and the refilled weld metal by tube expansion and welding respectively. The joint connections made in FIG. 11 rely on the presence of crevices which are situated about each tube and extend axially between the outer weld joint and the inner expanded joint to provide fluid communication to headers 58.

It is to be understood that other weld joint geometries and outer tubesheet cover shapes such as butt joints and multidirectional cover pieces respectively, are considered to be within the scope of the present invention's composite tubesheet structure. Such additional joint geometries and tubesheet cover shapes provide a choice of joint flexibility appropriate to the application and a variety of physical configurations suitable to the inspection procedures desired. The shape of fluid streamlines into and out of the tubes constitute an additional basis for selecting the shape of the tubesheet cover pieces.

It will now be apparent that an improved tube to composite tubesheet connection system has been provided in which relatively removable, outer tubesheets are utilized to obtain better access to the inner tube-to-tubesheet joints so as to make feasible the welding of those joints, to provide better tube-to-tubesheet leak localization for making repairs subsequent to leak detection, to secure greater flexibility at tube-to-tubesheet joints so as to alleviate residual and thermal stresses under a variety of transient service conditions, and to permit utilization of single or duplex tubes with or without tubeplate cladding.

We claim:

1. A heat exchanger apparatus comprising:

a shell structure;

a plurality of tubes disposed in said shell structure; and a tubesheet apparatus which cooperates with the shell in isolating the shell's interior from the tubes' interiors, said tubesheet apparatus including an inner tubesheet and an outer tubesheet structure each of which have a plurality of holes for the reception of said tubes, said outer tubesheet structure constituting a plurality of cover strips each of which have a dished, channel-shaped inner surface which cooperates with both the inner tubesheet's outer surface and with a predetermined number of said tubes to provide a fluid-tight cavity.

2. The apparatus of claim 1 wherein said cover strips have edges which are joined to said inner tubesheet between tube holes.

3. The apparatus of claim 1 wherein at least one of said cover strips is oriented to cooperate with a row of tubes to form a fluid-tight cavity.

4. A method of joining a composite tubesheet apparatus comprising:

sealing a plurality of tubes which extend through an inner tubesheet in fluid-tight contact therewith;

attaching a plurality of outer tubesheet cover strips each having a channel-shaped surface in fluid tight contact with the inner tubesheet such that each of the channel-shaped surfaces cooperate with the inner tubesheet to provide a cavity therebetween; and sealing said tubes in fluid-tight contact with said cover strips.

* * * * *